US005575215A

United States Patent [19]

Egli et al.

[11] Patent Number: 5,575,215

[45] Date of Patent: Nov. 19, 1996

[54] BYPASS FOR THE CARS OF A CIRCUIT CABLE RAILWAY SYSTEM

[75] Inventors: Ernst Egli, Hittnau; Felix Inauen, Bazenheid, both of Switzerland

[73] Assignee: Garaventa Holding AG, Goldau, Switzerland

[21] Appl. No.: 400,823

[22] Filed: Mar. 8, 1995

[30] Foreign Application Priority Data

Mar. 11, 1994 [CH] Switzerland ..... 726/94
Sep. 6, 1994 [CH] Switzerland ..... 2725/94

[51] Int. Cl.[6] ..... F01B 25/15; B61B 9/00

[52] U.S. Cl. ..... 104/99; 104/35; 104/173.1; 104/178; 104/179; 104/180; 104/88.02

[58] Field of Search ..... 104/35, 38, 94, 104/95, 96, 99, 88.2, 88.3, 173.1, 178, 179, 180, 197

[56] References Cited

U.S. PATENT DOCUMENTS

| | | | |
|---|---|---|---|
| 3,789,280 | 1/1974 | Oldfield | 318/45 |
| 3,866,537 | 2/1975 | Minkwitz | 104/99 |
| 4,509,430 | 4/1985 | Creissels | 104/180 |
| 4,619,206 | 10/1986 | Creissels | 104/178 |
| 4,848,241 | 7/1989 | Kunczynski | 104/173.1 |
| 4,958,574 | 9/1990 | Meindl | 104/178 |
| 5,060,576 | 10/1991 | Creissels | 104/178 |
| 5,127,336 | 7/1992 | Wakabayashi | 104/35 |

FOREIGN PATENT DOCUMENTS

| | | |
|---|---|---|
| 0226838 | 7/1987 | European Pat. Off. . |
| 245163 | 11/1987 | European Pat. Off. . |
| 285516 | 10/1988 | European Pat. Off. . |
| 306771 | 3/1989 | European Pat. Off. . |
| 369981 | 5/1990 | European Pat. Off. . |
| 0399919 | 11/1990 | European Pat. Off. . |
| 0461954 | 12/1991 | European Pat. Off. . |
| 687060 | 8/1930 | France . |
| 2496029 | 12/1980 | France . |
| 920114 | 3/1963 | United Kingdom . |
| 1370181 | 10/1974 | United Kingdom . |
| 8909714 | 10/1989 | WIPO . |

*Primary Examiner*—S. Joseph Morano
*Attorney, Agent, or Firm*—Sughrue, Mion, Zinn, Macpeak & Seas

[57] ABSTRACT

A bypass for a car of a circuit cable railway system, which is positioned at a turn-about station of the system between the incoming and outgoing lines of at least one revolving conveying cable. The bypass includes coupling points, disposed on incoming and outgoing tracks of the station, at which the car is decoupled from the conveying cable when entering the station and coupled to the conveying train cable when exiting the station. A conveying apparatus drives the car, which has been decoupled from the conveying cable, at a feeding velocity around the station on a station track, and accelerates movement of the car on the station track to enable the car to recouple with the conveying cable at the coupling point when exiting the station. The station track has an incoming portion at the location where the car enters the station and an outgoing portion at a location where the car exits the station. At least one turn-about wheel turns the conveying cable around to allow the one conveying cable to enter and exit the station. A side track is disposed between the incoming and outgoing portions of the station track, and a rotary switch, disposed on the station track, swivels to optionally direct the car to continue on the station track or to enter the side track. A control device controls the conveying apparatus and the rotary switch.

23 Claims, 7 Drawing Sheets

Fig. 5a
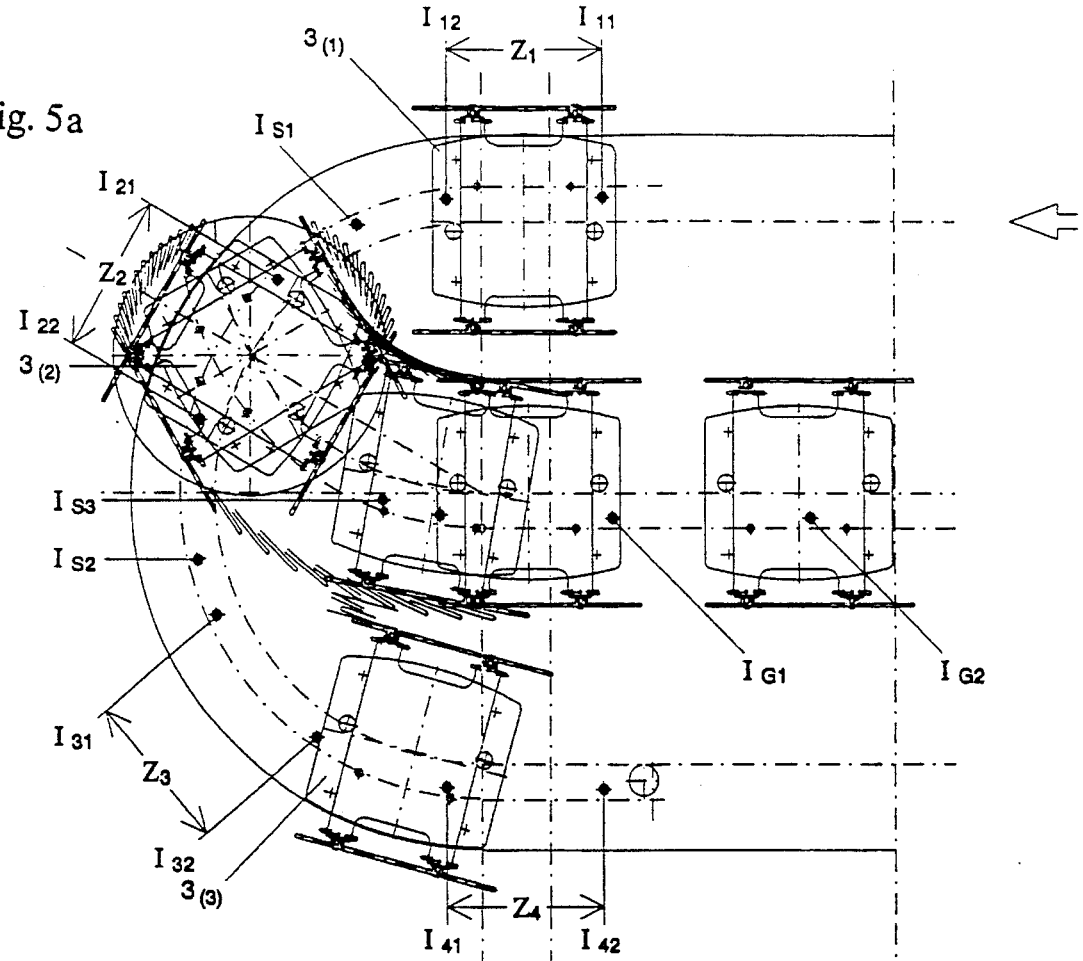
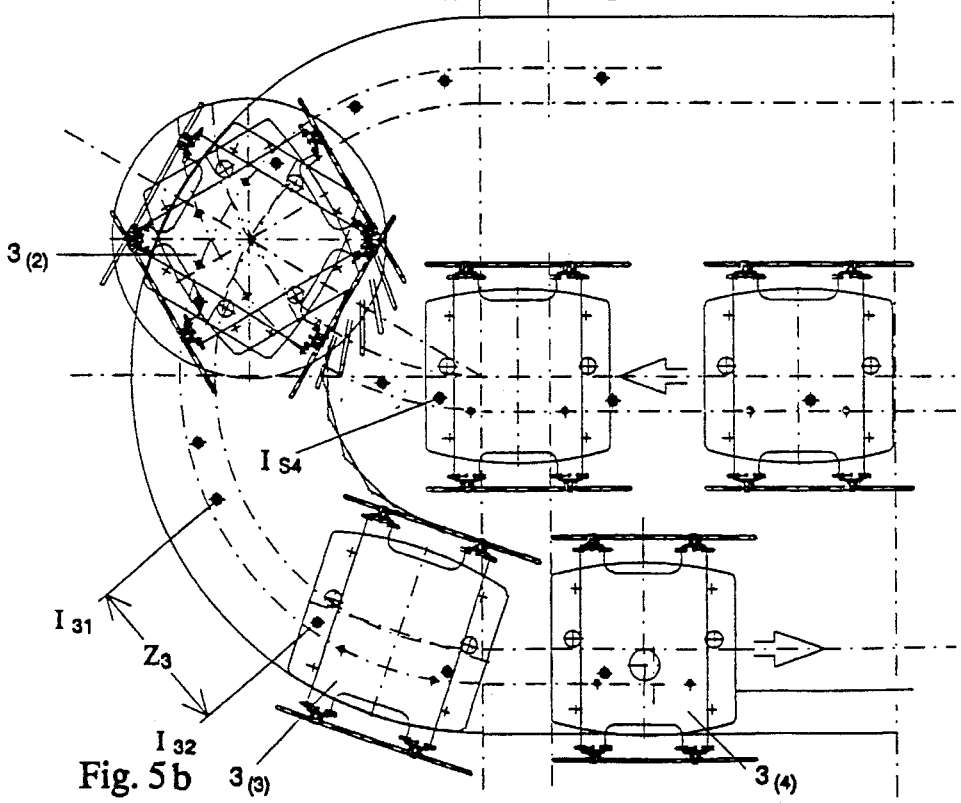
Fig. 5b

BYPASS FOR THE CARS OF A CIRCUIT CABLE RAILWAY SYSTEM

BACKGROUND OF THE INVENTION

1. Field of the Invention:

The present invention relates to a bypass for cars of a circuit cable railway system, and in particular, to a bypass having a side track disposed between the incoming and outgoing tracks of the bypass and a rotating platform for directing the cars to and from the side track.

2. Description of the Related Art:

A conventional circuit cable railway includes at least one conveying cable, to which carrying cars are attached, and has at least two stations, for example, a valley and a mountain station. These stations are the turn-about stations at which the conveying cable is turned by turn-about wheels, which are either towed or driven. An intermediate station can be placed between the mountain and valley stations, through which the conveying cable passes and through which the cars are slowly advanced.

Coupling points are typically present at the incoming as well as the outgoing sides of the stations. At the incoming coupling point, the cars advancing on the conveying train cable at, for example, up to 6 m/sec are decoupled from the cable and slowed to a slow feeding velocity of about 0.2 m/sec, at which rate they drive around the platform of the station on a station track.

In the stations, the station track extends from the incoming coupling point to the outgoing coupling point. Hence, the passengers can board and depart from the cars at the platform. At the outgoing coupling point, the cars are accelerated to a velocity synchronous to that of the conveying train cable and recoupled to the cable.

In order to adapt the circuit cable railway system to the required transportation capacity at a given time, unused cars are parked on the side tracks of a garage at any of the stations. The garage capacity is estimated by the entire number of cars that are parked and protected from the weather when the system is not in operation.

Since the turn-about wheels for the conveying cable at a turn-about station are generally placed directly between the incoming and outgoing portion of the station tracks, the side tracks of the garage are usually situated outside of the station tracks, and are typically arranged in the shape of a loop. The cars are directed to the side track by an incoming switch and fed out from the side track by an outgoing switch, as shown, for example, in European Patent Applications EP 369 981 B1, EP 306 771 B1, EP 245 163 B1 or French Patent Application FR 24 96 029.

In FIG. 3 of EP 369 981 B1, the station track of a bypass is shown, on which the gears, moving synchronously in the direction of travel, are connected together and guided over intermediate gears, and the cars are advanced through the station track while frictionally engaged therewith. A DMC cable guidance is described in EP 399 919 A1. Two self-contained conveying train cables are diverted from the level of the coupling point at the station, before they turn around at the mountain and valley stations. Each of the conveying cables are crossed once to change tracks on the turn-about wheels, and are conveyed in parallel in the area of the conveying track at the same height.

Both synchronous cables create a broad mountain to valley track across which the cars are conducted stably, and are virtually unaffected by crosswinds. Since the cable turn-abouts occur in levels moving opposite the coupling points, the bypass is free of turn-about wheels. Column 6, lines 8–16, of EP 399 919 A1 further describe the side tracks of the garage as being positioned in an open area between the mountain line and valley line at each station.

SUMMARY OF THE INVENTION

An object of the present invention is to provide a simple procedure for manipulating cars in the bypass. To achieve this object, the bypass has at least one turn-about wheel situated at each turn-about station, that turns at least one conveying train cable around in a plane opposite to the coupling points of the station. The bypass further includes a side track at both turn-about stations. The side track is arranged between the incoming and outgoing station tracks.

One rotary switch is located in the station track. The track on the rotary switch can be swivelled on a rotary plate to direct cars either along the station track or onto the side track of the garage. The rotary switch and the side track can be triggered synchronously by a control device which frictionally advances the cars.

In the present invention, the areas between the incoming and outgoing station tracks at each station are free from turn-about wheels. Instead, the side track is positioned between the incoming and outgoing station track. To conduct the cars on the station track, the rotary switch and the side track, multiple frequency controlled individual drives that can be triggered in groups are arranged to move synchronously in the direction of travel of the cars. These drives grip the cars from above or below with pneumatic wheels which are frictionally engaged with the cars.

The cars are any typical type of car, such as a gondola or a seat. When the cars are gondolas, the pneumatic wheels of the drives grip from underneath the cabin floor of the gondola to move the gondola along the station track, rotary switch and side track. Alternatively, when the cars are seats, the pneumatic wheels are situated above and act on the cable clamp, which clamps the seats to the conveying cable, to move the seats.

The invention is advantageous over the conventional system because the station track is divided with initiators into several, preferably four, zones which trigger and reverse the individual drives in the corresponding zone. Specifically, each zone is bordered by two initiators which sense the beginning and end of a car, and trigger the appropriate individual drives, that is, to stop or put the car in motion again or, when necessary, to steer around a point.

The stops are defined on the station track as deemed appropriate. A first stop exists in front of the rotary switch. At that front stop, a subsequent car is stopped until movement of the switch is finished. A second stop is the middle of the rotary plate of the switch. A third zone determines a safety distance that a leading car must be from the rotary plate, so that cars can enter and leave the side track without colliding. A fourth zone determines the start position of the car to leave the stop and accelerate.

Each garage parking space is monitored by an additional initiator. A security initiator is arranged on each of the junction tracks of the rotary switch. The departing of a car from the side track is monitored by a further security initiator which regulates a stop in front of the rotary switch. Each garage parking space is monitored by a further initiator.

The rotary switch has a lifting device with which the car located on the rotary plate of the switch can be raised with its running wheels to the level of the platform. Cars in need of maintenance can then be easily taken from operation, parked on the platform and inserted again on the station track or the side track when the maintenance is completed.

The endless conveying train cable can consist of MC (mono cable) cable guidance in the generally known fashion. A DMC (duo mono cable) cable guidance, as is, for example, described in the above mentioned EP 399 919 A1, adds an improved stability to the car to make the car stable against crosswinds. A QMC (quattro mono cable) cable guidance is also suitable, compared with for example EP 285 516 A2, when a bypass free of turn-about wheels is provided at a station.

Preferably, in the present invention, DMC cable guidance is used. Hence, a single self-contained traction cable, that has been crossed once to create a pair of traction cables with two synchronized loop areas turned at different heights and led in parallel at the same or substantially the same height in the track area in the diverted turn-about area opposite the coupling points, is used as described, for example, in Swiss patent application, file number 726/94, filed on Mar. 11, 1994, from which the present application claims priority.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which:

FIG. 5*a* illustrates how the cars enter the garage in a parking mode;

FIG. 5*b* illustrates how the cars leave the garage;

DETAILED DESCRIPTION OF THE PREFERRED EMBODIMENTS

Figure 1:
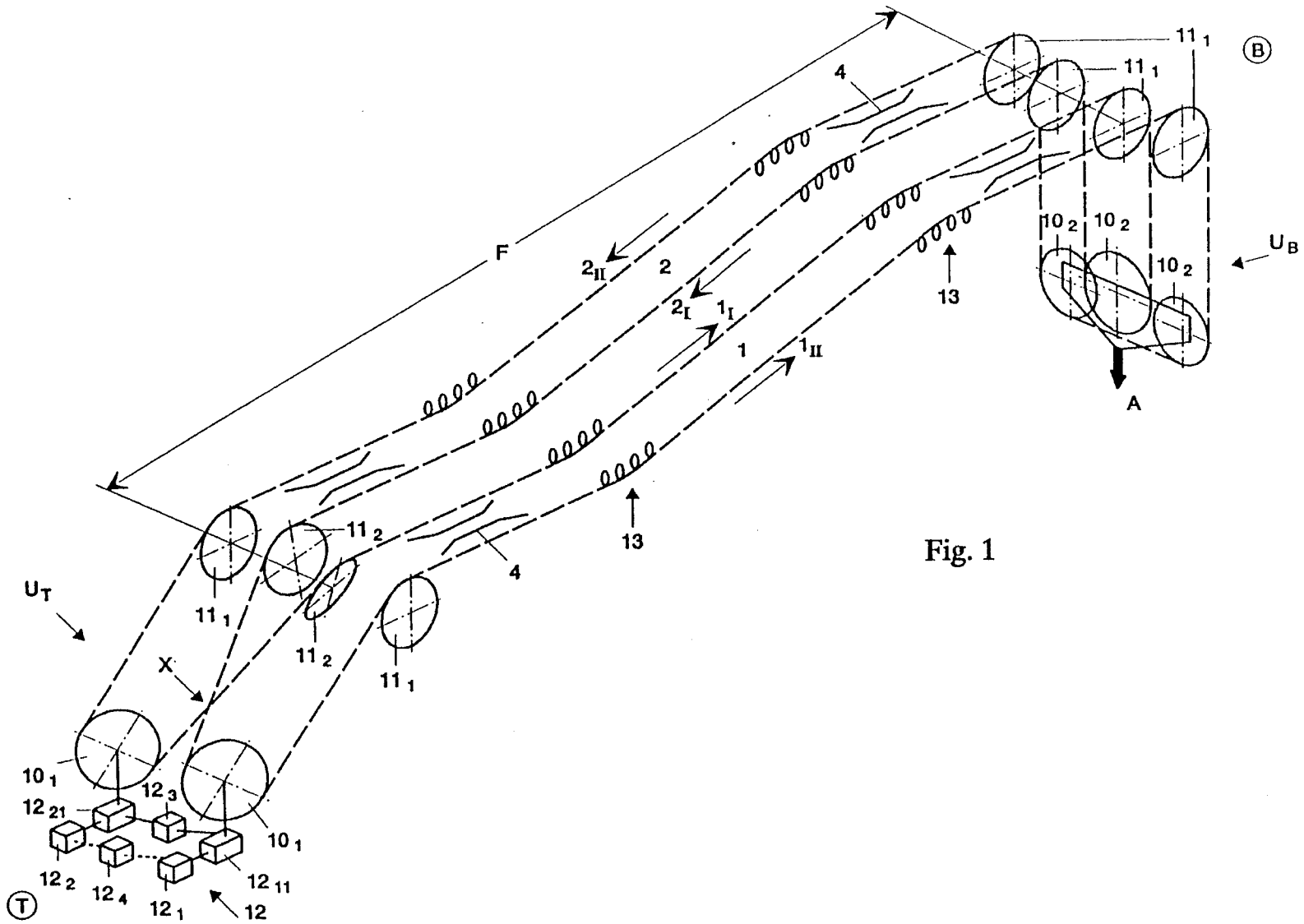
FIG. 1 shows a schematic perspective of DMC cable guidance of a circuit cable railway in accordance with an embodiment of the present invention.

FIG. 1 is a schematic diagram of a DMC (duo mono cable) cable guidance system according to the present invention.

The valley station T of the cable railway is the driving station. The valley station T houses drive wheels $\mathbf{10}_1$. The drive wheels $\mathbf{10}_1$ are spaced laterally from one another, and are driven independently but synchronously by separate electrical drive motors $\mathbf{12}_1$ and $\mathbf{12}_2$ via step-down gears $\mathbf{12}_{11}$ and $\mathbf{12}_{21}$, respectively. Mountain station B, which is a turn-about station, houses three towed turn-about wheels $\mathbf{10}_2$, which are positioned next to one another so that they can rotate. The turn-about wheels $\mathbf{10}_2$ are anchored at position "A" by weights (not shown), or alternatively, by a hydraulic tension system (not shown).

A single self-contained traction cable is looped about the drive wheels $\mathbf{10}_1$, and turn-about wheels $\mathbf{10}_2$, such that it crosses once to create a pair of cable loops. The traction cable is also looped about slanted castor wheels $\mathbf{11}_2$ and the cable crossing point is marked with an X. This arrangement thus forms inner cable loops and outer cable loops.

The loop designated as the inner cable loop extends from the middle turn-about wheel $\mathbf{10}_2$ through the mountain station B, to both slanted castor wheels $\mathbf{11}_2$, after which the cable crosses and extends to drive wheels $\mathbf{10}_1$. The loop designated as the outer cable loop extends from both outer turn-about wheels $\mathbf{10}_2$, which are laterally symmetrically displaced on opposite sides of the middle turn-about wheel $\mathbf{10}_2$, through the mountain station B to both drive wheels $\mathbf{10}_1$ in the valley station T.

Also, four additional castor wheels $\mathbf{11}_1$ are horizontally displaced at the mountain station B, and two additional castor wheels $\mathbf{11}_1$ are positioned the valley station T. The traction cable loops about these additional castor wheels $\mathbf{11}_1$ so that it is directed to the turn-about wheels $\mathbf{10}_2$ and drive wheels $\mathbf{10}_1$. The middle turn-about wheel $\mathbf{10}_2$, that effects turning of the inner cable loop, is displaced in an upward direction with respect to the outer turn-about wheels $\mathbf{10}_2$ which turn the outer cable loop. Also, both drive wheels $\mathbf{10}_1$ are displaced from one another in an upward direction.

The synchronized areas of both the inner and outer cable loops are parallel or substantially parallel to each other within the track F and form two tracks, namely, mountain track 1 and valley track 2. That is, the portions of the inner and outer loops which travel in the direction toward the mountain comprise the mountain track 1, while the portions of the inner and outer loops which travel in the direction toward the valley comprise the valley track 2.

The exact synchronization of the conveying cables is achieved by synchronizing the speed of both independently driven drive wheels $\mathbf{10}_1$. One drive motor $\mathbf{12}_1$ is operated as the main motor and the other drive motor $\mathbf{12}_2$ is operated as a secondary motor according to the master-slave principle. The armature current of the main motor $\mathbf{12}_1$ is measured and creates the input signal for a control device $\mathbf{12}_4$, which adjusts the armature current of the secondary motor $\mathbf{12}_2$ to correspond to that of the main motor $\mathbf{12}_1$. The step-down gear $\mathbf{12}_{11}$ of the main motor $\mathbf{12}_1$ and the step-down gear $\mathbf{12}_{21}$ of the secondary motor $\mathbf{12}_2$ are connected together across a differential gear $\mathbf{12}_3$, which is shown schematically in FIG. 1.

In the area of track F, that is, the area between the castor wheels 11, on each stopping station B and T, the four synchronized conveying cables $\mathbf{1}_I$, $\mathbf{1}_{II}$ and $\mathbf{2}_I$, $\mathbf{2}_{II}$, which are led in parallel or substantially in parallel at the same or about the same height, are adapted to the conditions of the slope by support rollers 13 mounted on supports (not shown).

A circuit cable railway comprises horizontally positioned coupling points 4 at the ends of the track F, that is, at the mountain B and valley T stations. A car (not shown) is hung from the conveying cable. The car travels at a low velocity when approaching a station track (not shown in FIG. 1), on which the passengers board and depart from the cars. A car is then accelerated to cable conveying velocity and recoupled to the conveying cable when leaving a station.

The turn-about area $U_T$ at the valley station T is displaced at an oblique angle with respect to the adjacent coupling points 4. The turn-about wheels $\mathbf{10}_2$ in turn-about area $U_B$ at mountain station B are vertically secured with weights (not shown) at location "A". At both stations B and T, the cars 3 drive around the platform 5 (see FIG. 2) at a slow travelling velocity on the station track to allow passengers to board and depart from the cars.

Figure 2:
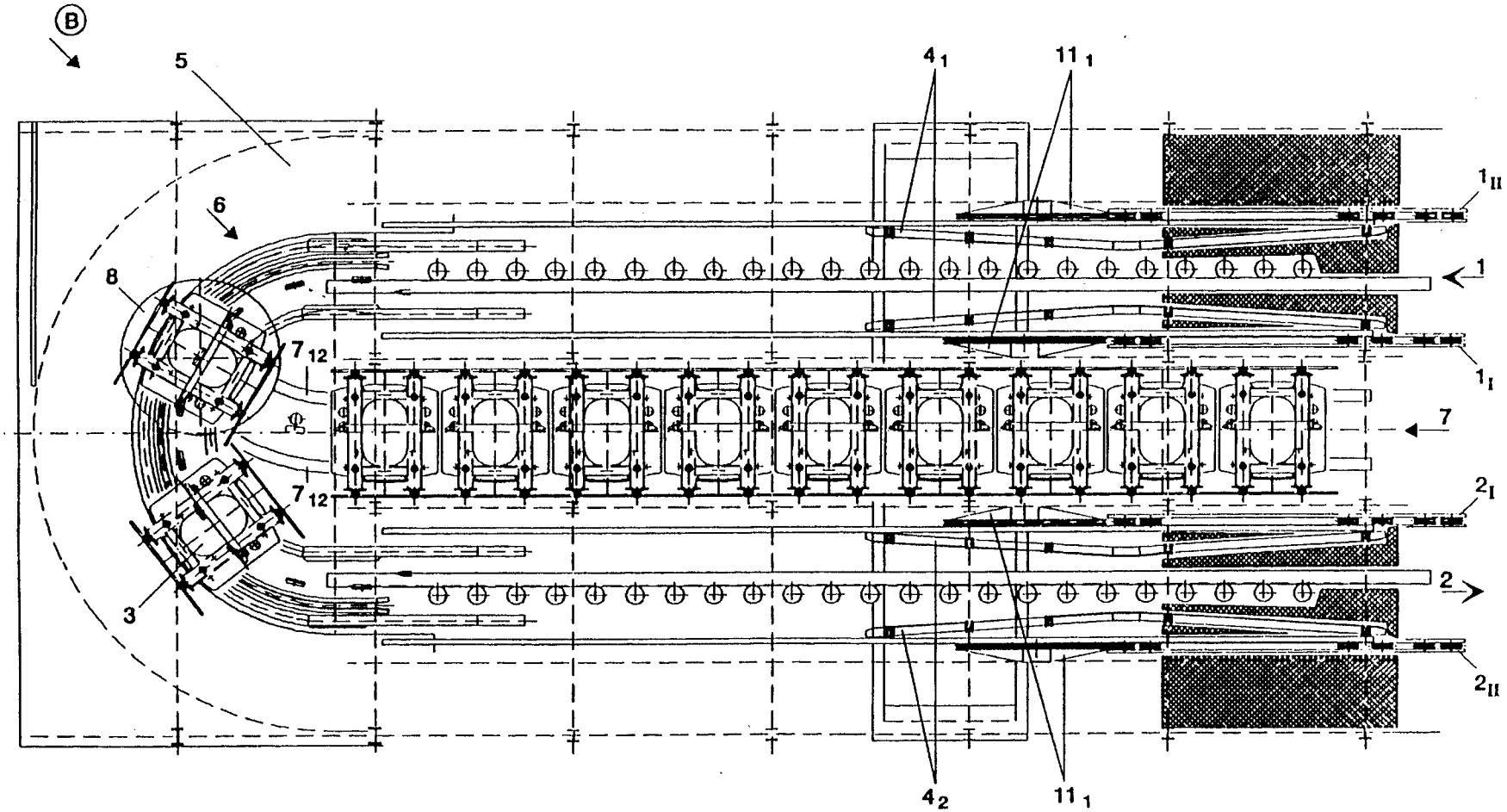
FIG. 2 shows a top view of an embodiment of the bypass of a stopping station according to the invention.

FIG. 2 illustrates a top view of the mountain station B. The incoming conveying cables $\mathbf{1}_I$ and $\mathbf{1}_{II}$ of the mountain track 1 are diverted from the plane of the incoming coupling point $\mathbf{4}_1$ by the castor wheels 11 and directed to turn-about wheels $\mathbf{10}_2$, as shown in FIG. 1. The outgoing conveying train cables $\mathbf{2}_I$ and $\mathbf{2}_{II}$ of the valley track 2 are directed from the castor wheels $\mathbf{11}_1$ again to the plane of the outgoing coupling point $\mathbf{4}_2$. The incoming coupling point $\mathbf{4}_1$ is adjacent to a slowing track, while the outgoing coupling point $\mathbf{4}_2$ is arranged near an acceleration track.

A station track 6 is disposed on platform 5, on which the passengers leave and enter the cars 3. Further, a side track 7, onto which cars 3 can enter or exit from station track 6 via a rotary switch 8, is disposed between the mountain 1 and valley tracks 2.

Figure 3:
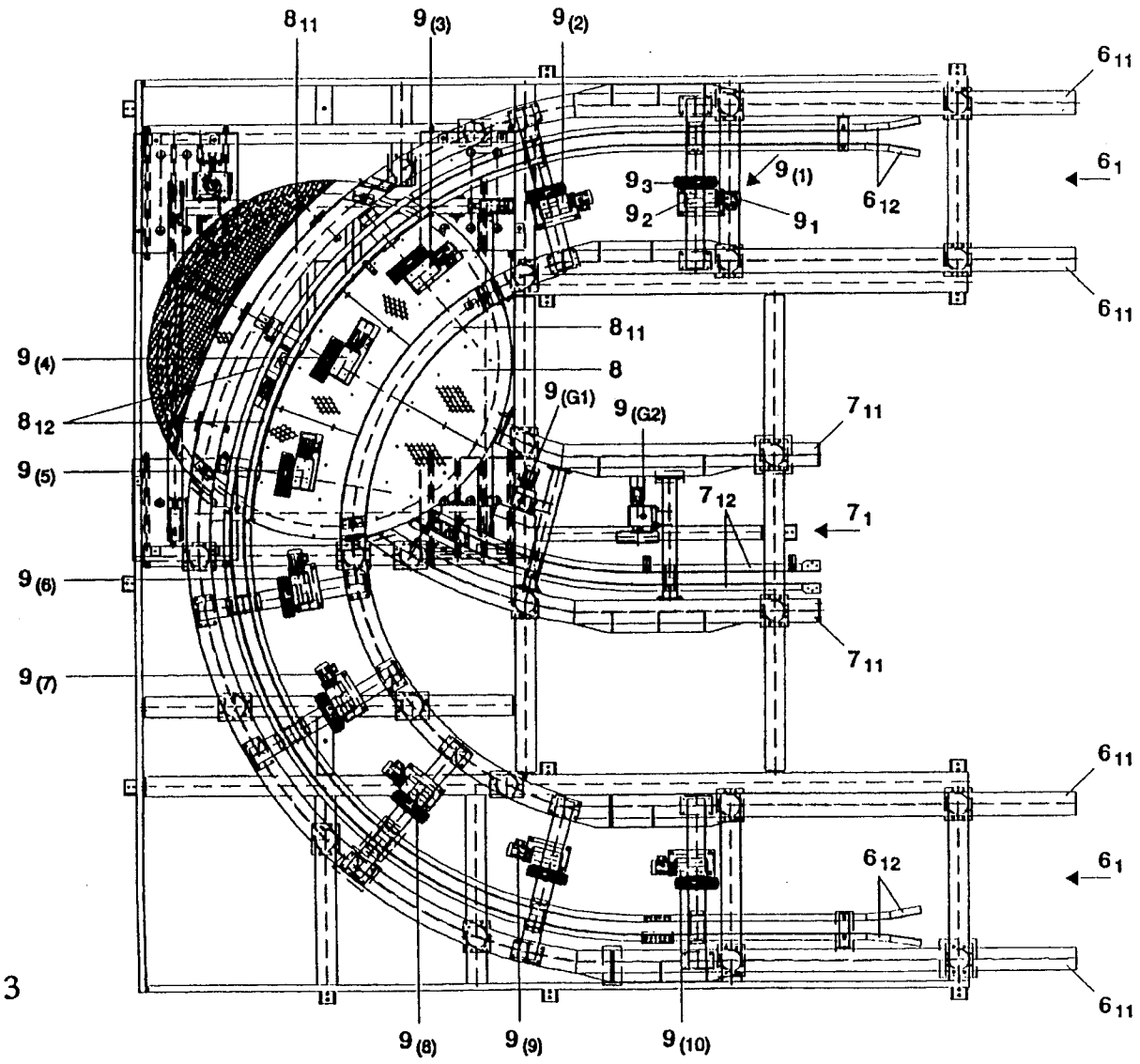
FIG. 3 is a top view of the station track, a rotary lifting switch and a side track situated between the mountain and valley tracks.

FIG. 3 shows a detailed view of the rotary switch 8. Track lines $\mathbf{6}_1$ of station track 6, track lines $\mathbf{7}_1$ of side track 7 and track lines $\mathbf{8}_1$ of rotary switch 8 each have two running rails $\mathbf{6}_{11}$, $\mathbf{7}_{11}$ and $\mathbf{8}_{11}$, respectively, on which the cars roll on running wheels $\mathbf{3}_2$ (see FIG. 6*a*), and two guide rails $\mathbf{6}_{12}$, $\mathbf{7}_{12}$ and $\mathbf{8}_{12}$, which interlock with two cogs ($\mathbf{3}_3$ in FIG. 6*a*) on the cars. In track lines $\mathbf{6}_1$, $\mathbf{7}_1$ and $\mathbf{8}_1$, a total of ten individual drives $\mathbf{9}_{(1)}$ through $\mathbf{9}_{(10)}$, which can be triggered by a control unit, are symmetrically displaced.

Each of the drives $\mathbf{9}_1$ through $\mathbf{9}_{10}$ consist of a frequency controlled electrical drive motor $\mathbf{9}_1$, whose rotational direction is reversible, and which operate across a step-down gear $\mathbf{9}_2$ to a pneumatic wheel $\mathbf{9}_3$ that is fitted with a tire. The tires of the pneumatic wheels $\mathbf{9}_3$ frictionally engage the car floor $\mathbf{3}_1$ (see FIG. 6*a*) from underneath and advance the car through the station track 6, or into or out of the side track 7.

Figure 4A:
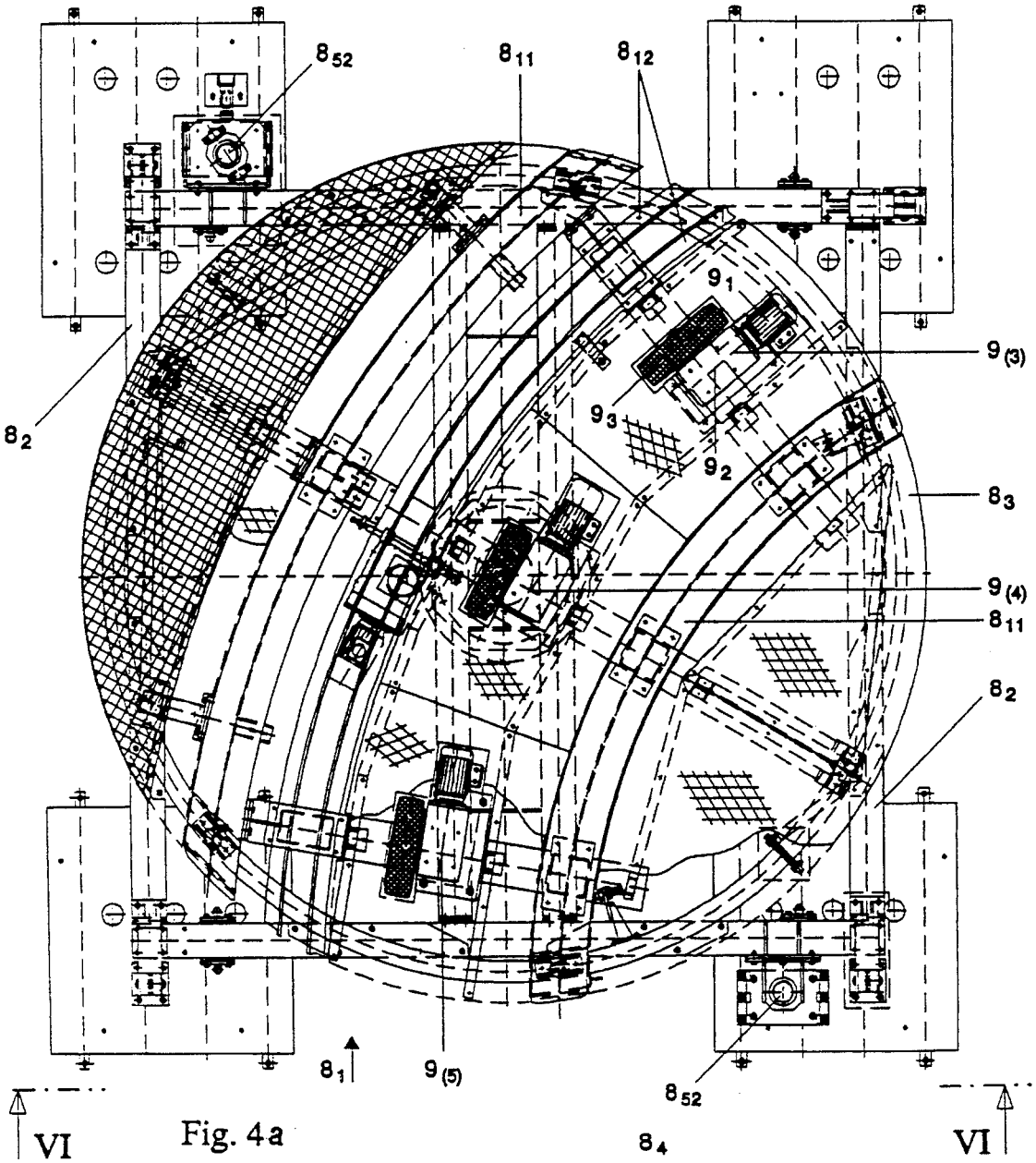
FIG. 4*a* illustrates a top view of the rotary lifting switch.
Figure 4B:
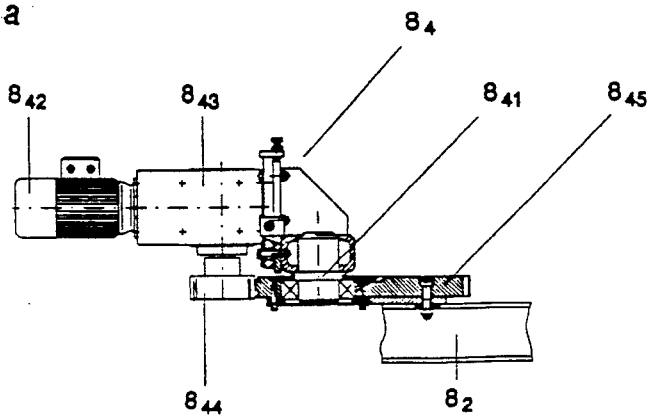
FIG. 4*b* shows a cross-sectional view of the rotary drive shown in FIG. 4*a;*

The rotary switch 8 is built onto a base frame $\mathbf{8}_2$ as shown in FIG. 4*a*. Rotary switch 8 has a rotary plate $\mathbf{8}_3$, with three individual gears $\mathbf{9}_{(3)}$ through $\mathbf{9}_{(5)}$, and a rotating device $\mathbf{8}_4$ positioned in the middle of base frame $\mathbf{8}_2$ (see FIGS. 4*b* and 6*a*). The rotating device $\mathbf{8}_4$, as shown in FIG. 4*b*, comprises an electrical drive motor $\mathbf{8}_{42}$ which drives, via a step-down gear $\mathbf{8}_{43}$, a pinion $\mathbf{8}_{44}$. The pinion $\mathbf{8}_{44}$ rolls together with the rotary plate $\mathbf{8}_3$ on a cogwheel $\mathbf{8}_{45}$ fastened to the base frame $\mathbf{8}_2$. The rotary plate $\mathbf{8}_3$ can be swivelled to 60° against the end stoppers, which are protected with end switches.

To maintain control when the cars 3 are entering and exiting the side track 7 garage, the track line $\mathbf{6}_1$ of station track 6 is subdivided, as shown FIGS. 5*a* and 5*b*, with a total of eight impulse-sensing initiators $I_{i1}$ through $I_{i2}$ (i being 1 through 4) in four zones $Z_1$ through $Z_4$. Three security initiators $I_{s1}$ through $I_{s3}$ are provided in the junction tracks 6 and 7 for monitoring the rotary plate $\mathbf{8}_3$. A fourth security initiator $I_{s4}$ identifies where the cars are to stop when leaving the side track 7. Each parking space in the side track 7 garage has an additional initiator $I_{Gi}$. Of course, the number of initiators and zones can be changed as desired according to design preference and necessity.

Each zone $Z_1$ through $Z_4$ is monitored by two initiators $I_{i1}$ and $I_{i2}$ which sense the car 3 from underneath and recognize the beginning (e.g., by $I_{i2}$) and the end (e.g., $I_{i1}$) of the car 3 which passes over these sensors. A control device triggers the ten individual drives $\mathbf{9}_{(1)}$ through $\mathbf{9}_{(10)}$ on the station track 6 and on the rotary switch 8, as well as the individual drives $\mathbf{9}_{(G1)}$, $\mathbf{9}_{(G2)}$, through $\mathbf{9}_{(Gi)}$ located as a group on the side track 7.

Zone $Z_1$, with initiators $I_{11}$ and $I_{12}$, is at the entrance of the station track 6. At that location, an incoming car $\mathbf{3}_{(1)}$ must wait until the car $\mathbf{3}_{(2)}$ on the rotary switch 8 has left the rotary switch 8, as shown in FIG. 5*a*. When a car exits the side track as in FIG. 5*b*, the track line $\mathbf{8}_1$ of the rotary switch 8 is set to "drive through" mode.

Two individual drives $\mathbf{9}_{(1)}$ and $\mathbf{9}_{(2)}$ are arranged in zone $Z_1$ (shown in FIG. 3). Zone $Z_2$, having initiators $I_{21}$ and $I_{22}$, determines the position of the car $\mathbf{3}_{(2)}$ on the rotary switch 8. The three individual drives $\mathbf{9}_{(3)}$ through $\mathbf{9}_{(5)}$, located on the rotary switch 8, belong to zone $Z_2$ (shown in FIG. 5*a*).

Zone $Z_3$, having initiators $I_{31}$ and $I_{32}$, determines a safety distance which the car driving ahead must be when the rotary switch 8 is in the "parking" mode and a car $\mathbf{3}_{(2)}$ is entering (FIG. 5*a*) or leaving (FIG. 5*b*) the side track 7. An exiting car $\mathbf{3}_{(2)}$ must wait on the side track 7 at security initiator $I_{s4}$, as shown in FIG. 5*b*, until the car $\mathbf{3}_{(3)}$ ahead on the station track 6 leaves zone $Z_3$. Three individual drives $\mathbf{9}_{(6)}$ through $\mathbf{9}_{(8)}$ are arranged in zone $Z_3$ (shown in FIG. 5*a*).

Zone $Z_4$, having initiators $I_{41}$ and $I_{42}$, lies across from entry Zone $Z_1$ and indicates the position of a car $\mathbf{3}_4$ which is leaving the bypass and is to be accelerated. Two individual drives $\mathbf{9}_{(9)}$ and $\mathbf{9}_{(10)}$ are in Zone $Z_4$. By controlling movement of the cars as described above, all cars on the circuit cable railway are able to enter or exit the side track 7 garage with maximum cable conveying velocity.

Figure 6A:
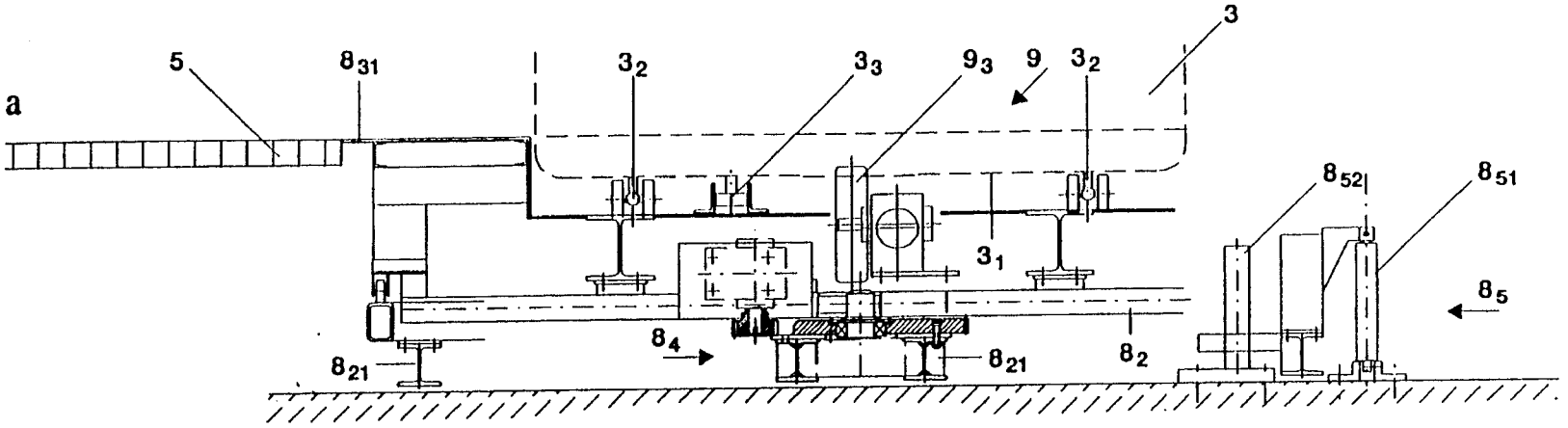
FIG. 6*a* illustrates a side view of a lifting device of the rotary lifting switch taken along arrows VI—VI in FIG. 4*a;*
Figure 6B:
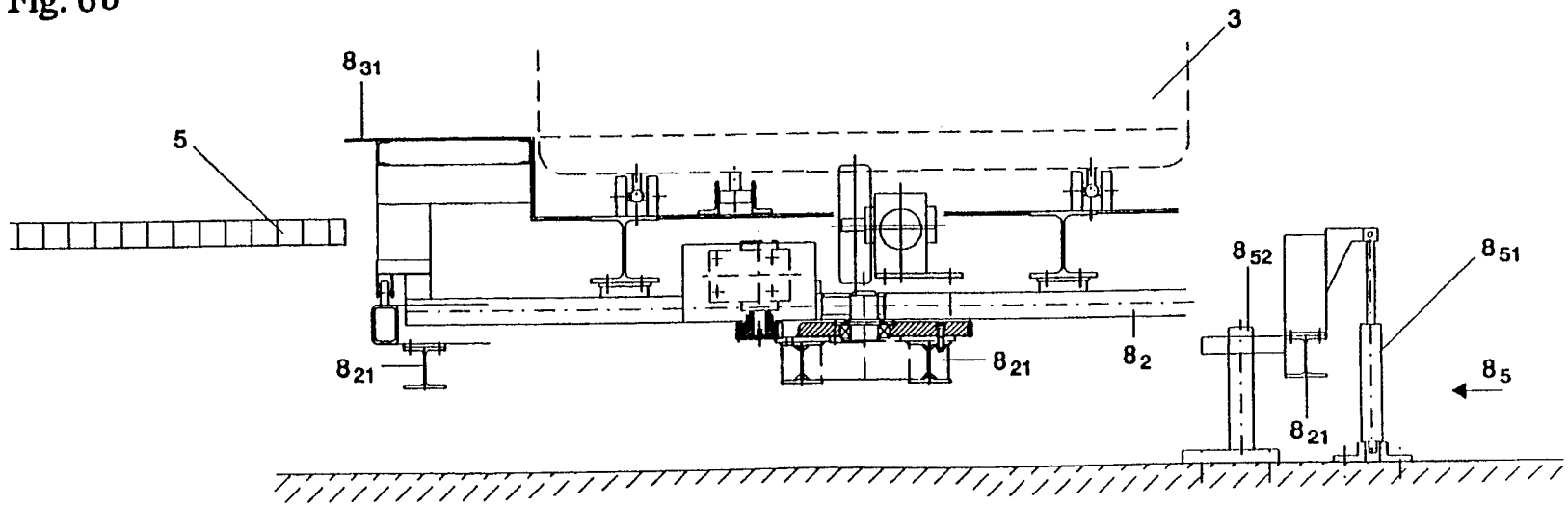
FIG. 6*b* shows the upper position of the lifting switch in a removal mode.

As shown in FIGS. 4*a*, 6*a* and 6*b*, the rotary switch 8 has a lifting device $\mathbf{8}_4$, with which a car standing on the rotary plate $\mathbf{8}_3$ is raised from the "drive through" mode, in which the edge $\mathbf{8}_{31}$ of the rotary plate is at or substantially at the height of the platform 5 as in FIG. 6*a*, to the "removal" mode, in which the car wheels $\mathbf{3}_2$ are positioned at or substantially at the height of the platform 5. The lifting device $\mathbf{8}_4$ comprises four simple lifting cylinders $\mathbf{8}_{51}$, which each engage a corner of the base frame $\mathbf{8}_2$, and two opposing check rails $\mathbf{8}_{52}$ that secure the position of the rotary lifting switch 8.

In the lower position as shown in FIG. 6*a*, the base frame $\mathbf{8}_2$ lies with its frame feet $\mathbf{8}_{21}$ at an adjustable altitude on the floor. The four lifting cylinders $\mathbf{8}_{51}$ can be triggered collectively in the "parking" mode, and are driven synchronously until they are secured by stoppers at. their upper ends (FIG. 6*b*) and monitored with end switches.

Figure 7:
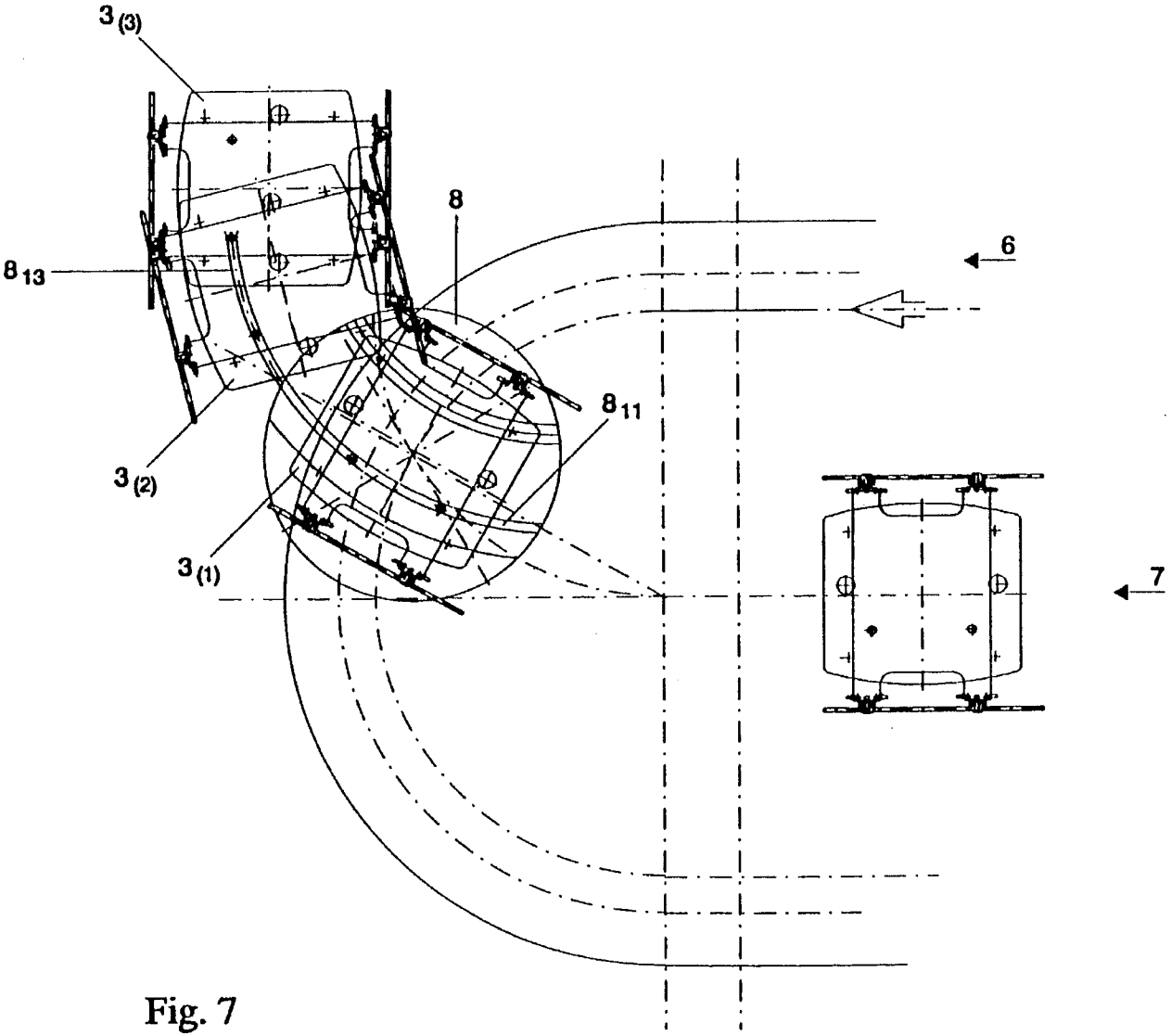
FIG. 7 illustrates the removal of a car from the bypass, its side-tracking on the platform and its reintroduction onto the bypass.

To remove a car 3 from the bypass, the control device is set to "removal" mode. As shown in FIG. 7, the car 3 to be taken out either drives from the station track 6 in the "drive through" mode, or from the side track 7 in the "parking" mode, to the rotary plate $\mathbf{8}_3$ of the rotary lifting switch 8. Then, the car 3 is stopped in the middle (zone $Z_2$) by individual drives $\mathbf{9}_{(3)}$ through $\mathbf{9}_{(5)}$ (shown FIG. 4*a*).

The rotary plate, turned to the "parking" mode, is brought to its upper end position by the lifting device $\mathbf{8}_5$, and the car $\mathbf{3}_{(1)}$ to be taken out is advanced by the individual drives ($\mathbf{9}_{(3)}$ through $\mathbf{9}_{(5)}$ as shown in FIG. 4*a*) of the rotary lifting switch 8, whose rotational direction has been reversed, to the position $\mathbf{3}_{(2)}$ on the platform 5. The guide rails $\mathbf{8}_{11}$ of the rotary lifting switch 8 are lengthened with an auxiliary guide rail $\mathbf{8}_{13}$. The car $\mathbf{3}_{(2)}$ to be taken out can be pushed by hand from this point, whereby from the illustrated position $\mathbf{3}_{(3)}$ it can be removed from the auxiliary guide rail $\mathbf{8}_{13}$. Afterwards, the empty rotary plate $\mathbf{8}_3$ is lowered, rotated to the "drive through" mode, and the control device set again to "drive through" mode.

To insert a car 3 in the bypass, the control device is set to "Insert" mode, and an empty rotary plate $\mathbf{8}_3$ is turned to "parking" mode and lifted to its upper end position. The car $3_{(3)}$ to be inserted is driven onto the auxiliary guide rails $8_{13}$, pushed by hand to the first pneumatic wheel $9_3$ of the individual drives located on the rotary lifting switch 8, advanced to position $3_{(1)}$ in the middle of the rotary plate $8_3$ (zone $Z_2$) and stopped. After lowering the rotary plate $8_3$, the car $3_{(1)}$ can be advanced immediately to the side track 7 or, after turning the rotary plate $8_3$ to the "drive through" mode, to the station track 6.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A bypass for a car of a circuit cable railway system, positioned at a turn-about station of the system between incoming and outgoing lines of at least one revolving conveying cable, comprising:

coupling points, disposed on incoming and outgoing portions of a station track in the station, at which the car is decoupled from the at least one conveying cable when entering the station and coupled to the at least one conveying cable when exiting the station;

a conveying apparatus which moves the car, which has been decoupled from the at least one conveying cable, at a feeding velocity around the station on the station track, and which accelerates movement of the car on the station track to enable the car to recouple with the at least one conveying cable at the coupling point when exiting the station;

at least one turn-about wheel that turns the at least one conveying cable around to allow the at least one conveying cable to enter and exit the station;

a side track disposed between the incoming and outgoing portions of the station track;

a rotary switch, disposed on the station track, which is swivelable to optionally direct the car to continue on the station track or to enter the side track; and a control device which controls the conveying apparatus and the rotary switch;

the conveying apparatus, rotary switch and side track each including individual drives, symmetrically disposed thereabout, to facilitate movement of the car as controlled by the control device; and the station track comprising a plurality of zones, each of said zones comprising at least one initiator which senses movement of the car and provides signals to said control device, said control device controlling said individual drives on the basis of said signals.

2. A bypass as claimed in claim 1, wherein said entry of the car onto the rotary switch and departure of the car from the rotary switch is monitored by some of said initiators.

3. A bypass as in claim 1, further comprising an additional initiator, disposed at the side track, which monitors entry and departure of the car onto and from the side track.

4. A bypass as claimed in claim 1, further comprising a plurality of additional initiators, disposed at the side track, which each monitor a parking space for the car on the side track.

5. A bypass as claimed in claim 1, wherein the rotary switch comprises a lifting device which raises the car to an upper position to allow the car to be removed from the station track or the side track, and lowers the car to a lower position to allow the car to be moved onto the station track or the side track.

6. A bypass as claimed in claim 1, further comprising an apparatus which crosses the cable once about itself to create a pair of cable loops, each of the cable loops including one of the incoming and outgoing lines.

7. A bypass as claimed in claim 6, further comprising an apparatus for directing the pair of cable loops to travel substantially parallel to each other at substantially the same height from the station to another station.

8. A bypass as claimed in claim 1, wherein the individual drives each comprise pneumatic wheels which frictionally engage the car to advance the car along the station track, rotary switch and side track.

9. A method for moving a car of a circuit cable railway system about a turn-about station of the system between the incoming and outgoing lines of at least one revolving conveying cable, comprising the steps of:

decoupling the car from the at least one conveying cable when the car enters the station and recoupling the car to the at least one conveying cable when the car exits the station;

conveying the car, which has been decoupled from the at least one conveying train cable, at a feeding velocity around the station on a station track, and accelerating movement of the car on the station track to enable the car to recouple with the at least one conveying cable when the car exits the station, the station track having an incoming portion at the location where the car enters the station and an outgoing portion at a location where the car exits the station;

turning the at least one conveying cable around to allow the at least one conveying cable to enter and exit the station;

controlling a rotary switch, disposed on the station track, to optionally direct the car to continue on the station track or to enter a side track which is disposed between the incoming and outgoing portions of the station track;

dividing the station track into a plurality of zones;

sensing movement of the car in the zones; and controlling movement of the car on the station track, rotary switch and side track based on the Sensed movement of the car.

10. A method as claimed in claim 9, wherein the conveying step includes the step of controlling individual drives, disposed at the station track, to move the car along the station track, and the controlling step includes the step of controlling individual drives, disposed at the rotary switch and side track, to move the car onto the side track from the rotary switch and vice versa.

11. A method as claimed in claim 9, further comprising the step of monitoring entry of the car onto the rotary switch and departure of the car from the rotary switch.

12. A method as claimed in claim 9, further comprising the step of monitoring entry and departure of the car onto and from the side track.

13. A method as claimed in claim 9, further comprising the step of monitoring parking spaces for the car on the side track.

14. A method as claimed in claim 9, further comprising the steps of:

when the car is positioned on the rotary switch, raising the car to an upper position to allow the car to be removed from the station track or the side track; and when the car is positioned on the rotary switch, lowering the car to a lower position to allow the car to be moved onto the station track or the side track.

15. A method as claimed in claim 9, wherein the at least one conveying cable is a single self-contained conveying train cable, and wherein the method further comprises the step of crossing the cable once about itself to create a pair of cable loops, each of the cable loops including one of the incoming and outgoing lines.

16. A method as claimed in claim 15, further comprising the step of directing the pair of cable loops to travel substantially parallel to each other at substantially the same height from the station to another station.

17. A method as claimed in claim 9, wherein the conveying step comprises the step of frictionally engaging the car to advance the car along the station track, and the controlling step comprises the step of frictionally engaging the car to advance the car from the rotary switch onto the side track and vice versa.

18. A bypass for a car of a circuit cable railway system, positioned at a turn-about station of the system between incoming and outgoing lines of at least one revolving conveying cable, comprising:

coupling points, disposed on incoming and outgoing portions of a station track in the station, at which the car is decoupled from the at least one conveying cable when entering the station and coupled to the at least one conveying cable when exiting the station;

a conveying apparatus which moves the car, which has been decoupled from the at least one conveying cable, at a feeding velocity around the station on the station track, and which accelerates movement of the car on the station track to enable the car to recouple with the at least one conveying cable at the coupling point when exiting the station;

at least one tUrn-about wheel that turns the at least one conveying cable around to allow the at least one conveying cable to enter and exit the station;

a side track disposed between the incoming and outgoing portions of the station track;

a rotary switch, disposed on the station track, which is swivelable to optionally direct the car to continue on the station track or to enter the side track, the rotary switch comprising a lifting device which raises the car to an upper position to allow the car to be removed from the station track or the side track, and lowers the car to a lower position to allow the car to be moved onto the station track or the side track; and a control device which controls the conveying apparatus and the rotary switch.

19. A bypass for a car of a circuit cable railway system, positioned at a turn-about station of the system between incoming and outgoing lines of at least one revolving conveying cable, comprising:

coupling points, disposed on incoming and outgoing portions of a station track in the station, at which the car is decoupled from the at least one conveying cable when entering the station and coupled to the at least one conveying cable when exiting the station;

a conveying apparatus which moves the car, which has been decoupled from the at least one conveying cable, at a feeding velocity around the station on the station track, and which accelerates movement of the car on the station track to enable the car to recouple with the at least one conveying cable at the coupling point when exiting the station;

at least one turn-about wheel that turns the at least one conveying cable around to allow the at least one conveying cable to enter and exit the station;

a side track disposed between the incoming and outgoing portions of the station track;

a rotary switch, disposed on the station track, which is swivelable to optionally direct the car to continue on the station track or to enter the side track; and a control device which controls the conveying apparatus and the rotary switch;

the conveying apparatus, rotary switch and side track each including individual drives, symmetrically disposed thereabout, to facilitate movement of the car as controlled by the control device, the individual drives each comprising pneumatic wheels which frictionally engage the car to advance the car along the station track, rotary switch and side track.

20. A bypass as claimed in claim 17, wherein the rotary switch comprises a lifting device which raises the car to an upper position to allow the car to be removed from the station track or the side track, and lowers the car to a lower position to allow the car to be moved onto the station track or the side track.

21. A bypass as claimed in claim 19, further comprising an apparatus which crosses the cable once about itself to create a pair of cable loops, each of the cable loops including one of the incoming and outgoing lines.

22. A bypass as claimed in claim 21, further comprising an apparatus for directing the pair of cable loops to travel substantially parallel to each other at substantially the same height from the station to another station.

23. A method for moving a car of a circuit cable railway system about a turn-about station of the system between the incoming and outgoing lines of at least one revolving conveying cable, comprising the steps of:

decoupling the car from the at least one conveying cable when the car enters the station and recoupling the car to the at least one conveying cable when the car exits the station;

conveying the car, which has been decoupled from the at least one conveying cable, at a feeding velocity around the station on a station track, and accelerating movement of the car on the station track to enable the car to recouple with the at least one conveying cable when the car exits the station, the station track having an incoming portion at the location where the car enters the station and an outgoing portion at a location where the car exits the station;

turning the at least one conveying cable around to allow the at least one conveying cable to enter and exit the station;

controlling a rotary switch, disposed on the station track, to optionally direct the car to continue on the station track or to enter a side track which is disposed between the incoming and outgoing portions of the station track;

when the car is positioned on the rotary switch, raising the car to an upper position to allow the car to be removed from the station track or the side track; and when the car is positioned on the rotary switch, lowering the car to a lower position to allow the car to be moved onto the station track or the side track.

* * * * *